US006622801B1

(12) United States Patent
Rondino

(10) Patent No.: US 6,622,801 B1
(45) Date of Patent: Sep. 23, 2003

(54) PORTABLE AEROSOL-TYPE FIRE-FIGHTING PROTECTION DEVICE

(75) Inventor: Angelo Rondino, Rome (IT)

(73) Assignee: Firecom s.r.l., Monterotondo Scalo (IT)

( * ) Notice: Subject to any disclaimer, the term of this patent is extended or adjusted under 35 U.S.C. 154(b) by 0 days.

(21) Appl. No.: 09/857,417

(22) PCT Filed: Dec. 17, 1999

(86) PCT No.: PCT/IT99/00413

§ 371 (c)(1),
(2), (4) Date: Jun. 4, 2001

(87) PCT Pub. No.: WO00/37142

PCT Pub. Date: Jun. 29, 2000

(30) Foreign Application Priority Data

Dec. 22, 1998 (IT) ..... RM98A0786

(51) Int. Cl.[7] ..... A62C 13/62

(52) U.S. Cl. ..... 169/71; 169/11; 169/74; 169/84

(58) Field of Search ..... 169/11, 12, 30, 169/71, 70, 84, 74

(56) References Cited

U.S. PATENT DOCUMENTS 3,139,934 A * 7/1964 Gorski ..... 169/11
3,369,609 A * 2/1968 Fogelgren ..... 169/74
3,889,758 A 6/1975 Dunn
5,441,114 A * 8/1995 Spector et al. ..... 169/12
5,660,236 A * 8/1997 Sears et al. ..... 169/84
5,848,649 A 12/1998 Matsumoto et al.
5,992,528 A * 11/1999 Parkinson et al. ..... 169/84

FOREIGN PATENT DOCUMENTS

| | | |
|---|---|---|
| GB | 1 268 839 | 3/1972 |
| WO | WO91/17797 | 11/1991 |
| WO | WO99/12610 | 3/1999 |

* cited by examiner

*Primary Examiner*—Steven J. Ganey
(74) *Attorney, Agent, or Firm*—Nixon & Vanderhye

(57) ABSTRACT

A portable aerosol-type-fire-fighting protection device comprises a hollow body (1) which includes in the interior (10) thereof, and communicating with the exterior by way of an opening (3), a chamber (11) for accommodating a solid substance (7) capable of being transformed at a given temperature into an aerosol with flame-extinguishing properties and being discharged as such by way of the opening. A handle (2) is fixed with respect to the body and within its interior there is a space. The accommodating chamber has an electrical resistor (12) for triggering the transformation from solid into aerosol, energised by way of a switch (13) from batteries (14) accommodated in the space (15) in the handle.

12 Claims, 1 Drawing Sheet

PORTABLE AEROSOL-TYPE FIRE-FIGHTING PROTECTION DEVICE

Figure 1:
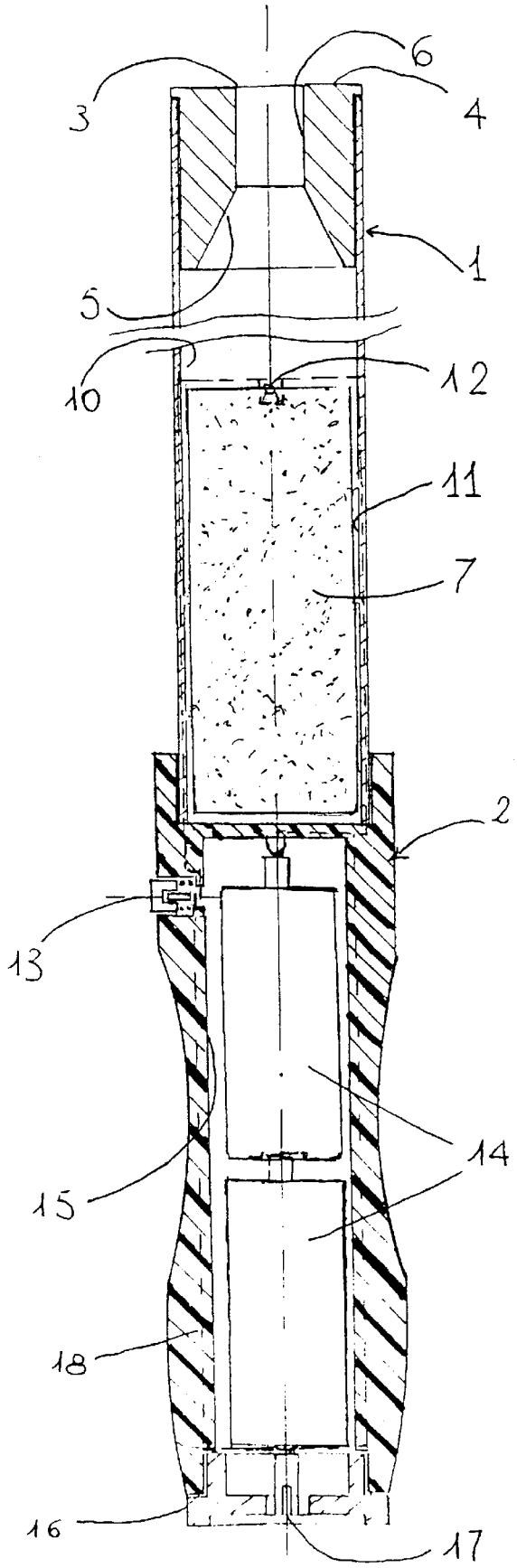

The present invention concerns a portable aerosol-type fire-fighting protection device.

Current portable extinguishers consist of a container or cylinder provided with a handle and a nozzle from which the extinguishing jet is caused to issue, solely by means of a second container or cylinder which is within the first mentioned container or cylinder and which contains a compressed gas. These extinguishers are heavy, bulky and inconvenient to use.

For fixed flame-extinguishing installations, it is already known to use potassium carbonate, which is transformed from a solid into an aerosol at a given temperature around 300° C. The grains of potassium carbonate in suspension are of a diametral size of around 4 microns and, in the proximity of a flame, they replace the air and thus the combustion-supporting oxygen. They are particularly effective, by virtue precisely of their very small grain size, in smothering any incipient fire.

The extinguishing capability of 1 kg of potassium carbonate corresponds to that of 1 $m^3$ of water.

In addition the exothermically formed carbonate is completely anhydrous and can thus be used for extinguishing an incipient fire on electrical equipment without incurring any risk of conduction caused by electrolytic phenomena of the potassium salt.

In accordance with the present invention there is provided a portable aerosol-type fire-fighting protection device comprising a hollow body which includes in its interior, and communicating with the exterior by way of an opening, a chamber for accommodating a solid substance capable of being transformed at a given temperature into an aerosol with flame-extinguishing properties and being discharged as such by way of the opening, and a handle which is fixed with respect to the hollow body and in the interior of which there is a space; wherein the accommodating chamber has an electrical triggering resistor supplied by way of a switch from batteries accommodated in the space in the handle.

The present invention will now be described with reference to a preferred embodiment thereof although it will be appreciated that modifications may be made without thereby departing from the scope of protection of the present invention, and with reference to the sole FIGURE of the accompanying drawing in which:

FIG. 1 is a partly sectional diagrammatic axial longitudinal view of the portable fire-fighting protection device according to the present invention.

FIG. 1 shows the general appearance of the fire-fighting protection device according to the invention as comprising a hollow body 1 and a handle 2 made of plastics material.

The hollow body 1 is a substantially tubular element, preferably of aluminium alloy. The interior 10 of the hollow body 1 is preferably of cylindrical shape and communicates with the exterior by way of an opening 3 provided with a nozzle-type closure element 4 at the end remote from the handle 2. From the interior towards the exterior, the closure element 4 has a frustoconical first passage portion 5 which converges to a cylindrical second passage portion 6.

A portion of the cylindrical interior 10 of the hollow body 1, which is disposed in the proximity of the handle 2, is a chamber 11 for accommodating a solid substance 7. The solid substance, such as potassium carbonate, is capable of being transformed at a given temperature into an aerosol with flame-extinguishing properties, and is capable of being discharged by way of the opening 3. The potassium carbonate, to which binding agents are added, is in the form of small cylindrical charge portions which can be accommodated in the interior of the combustion chamber. As diagrammatically illustrated, the accommodating chamber 11 includes an electrical resistor 12 for triggering the transformation from solid into aerosol, at approximately 300° C. The resistor 12 is supplied with electric current by way of a switch 13, for example a push-button switch, from batteries 14 which are accommodated in a space 15 in the handle 2.

The triggering circuit, comprising the resistor 12, the switch 13 and the batteries 14, is diagrammatically indicated by a broken line 18. The triggering circuit 18 includes contacts (not shown in detail) between the body 1 and the handle 2 at the point of insertion of the body into the handle. The portion of the triggering circuit 18 in the handle 2 comprises the switch 13 and the batteries 14, while the portion of circuit in the hollow body 1 includes the triggering resistor 12.

The connection between the hollow body 1 and the handle 2 is represented as being of the type involving a male-female press fit. It can however also be of a screw type.

The closure nozzle element 4 involves a large mass for cooling the aerosol as it passes through the nozzle element towards the exterior. Even though not shown in the drawing, the chamber 11 occupies approximately half the hollow body 1 adjacent the handle 2.

The batteries 14 are preferably rechargeable, and the space in the handle which accommodates them is then provided with a closure member 16 having a coaxial electrical connecting plug 17 for discharging and recharging the batteries.

For loading, the extinguisher the body 1 is separated from the handle 2 to insert one or more charge cylinders of the substance, such as potassium carbonate, which is intended to be transformed into an aerosol.

When the body 1 is re-connected to the handle 2 the charge cylinder which is closest to the opening 3 is in contact with the triggering resistor 12. When the resistor 12 is powered up by means of closure of the triggering circuit 18 by operation of the push button switch 13, the potassium carbonate is transformed into an aerosol which is dispersed in the air present in the internal cylinder 10 of the body 1, to be discharged in a suitably cooled condition by way of the nozzle 4 of the opening 3 of the body 1. The aerosol thus surrounds the seat of the fire, smothering it.

The advantages of the invention will be appreciated. The lightness and reduced dimensions of the device of the invention increase the ease of handling thereof. By virtue of the simple handle the invention can be directed easily on to the seat of the fire and the flow of aerosol issuing from its opening accurately reaches the heart of the flame, thus exploiting the full efficiency of the very small grain size powder of potassium carbonate in terms of smothering it, while being totally safe even on metal and electrical parts.

The device according to the invention is also of extremely moderate cost in comparison with current portable extinguishers.

On the other hand, by virtue of the option of recharging the batteries, the circuit for triggering off the reaction is completely safe for the user and is particularly convenient.

It will be appreciated that the dimensions and the shape of the device, and moreover the materials constituting it, can be appropriately selected to ensure that the user is not at all inconvenienced by the heat produced by the exothermic reaction of the potassium carbonate and it is being transformed from solid to aerosol.

What is claimed is:

1. A portable aerosol-type fire-fighting protection device comprising: a hollow body having an interior and an opening for communicating with the exterior by way of the opening, a chamber for accommodating a solid substance capable of being transformed at a given temperature into an aerosol with flame-extinguishing properties and of being discharged in aerosol form by way of the opening without pressurization apart from the transformation of the substance into the aerosol, a handle fixed with respect to the hollow body and defining an interior space, and an electrical circuit including batteries within said space, a switch and an electrical resistor in the chamber in contact with the substance for triggering the transformation of the substance from a solid to an aerosol upon closing the electrical circuit.

2. A device according to claim 1 wherein the hollow body comprises a cylindrical tube having the opening at an end remote from the handle.

3. A device according to claim 2 wherein the opening of the hollow body is provided with a nozzle closure element having, from the interior outwardly, a frustoconical first passage portion which is convergent into a cylindrical second portion.

4. A device according to claim 3 wherein the nozzle element includes a large mass for cooling the aerosol as it passes therethrough towards the exterior.

5. A device according to claim 1 wherein the accommodating chamber is in the proximity of the handle and occupies approximately half the hollow body.

6. A device according to claim 1 wherein the solid substance consists of potassium carbonate.

7. A device according to claim 6 wherein the potassium carbonate is in the form of a cylindrical cartridge which can be accommodated in the interior of the accommodating chamber.

8. A device according to claim 1 wherein said switch is a push button switch.

9. A device according to claim 1 wherein the batteries are rechargeable, and the space in the handle which accommodates the batteries is provided with a closure member having a coaxial electrical plug for recharging the batteries.

10. A device according to claim 1 wherein the hollow body is formed of an aluminum alloy and the handle is formed of a plastics material.

11. A device according to claim 1 wherein the hollow body is a male-female force fit with respect to the handle.

12. A portable aerosol-type fire-fighting protection device comprising a hollow body having an interior and an opening for communicating with the exterior by way of the opening, a chamber for accommodating a solid substance, said solid substance consisting of potassium carbonate capable of being transformed at a given temperature into an aerosol with flame extinguishing properties and of being discharged in aerosol form by way of the opening, a handle fixed with respect to the hollow body and defining an interior space, and an electrical circuit including batteries within said space, a switch and an electrical resistor in contact with the potassium carbonate for triggering the transformation from solid to aerosol upon closing the electrical circuit.

* * * * *